United States Patent [19]

Ruland

[11] Patent Number: 4,838,134

[45] Date of Patent: Jun. 13, 1989

[54] TORQUE WRENCH

[75] Inventor: Fred F. Ruland, Weston, Mass.

[73] Assignee: Ruland Manufacturing Company, Inc., Watertown, Mass.

[21] Appl. No.: 204,709

[22] Filed: Jun. 9, 1988

[51] Int. Cl.[4] ..... B25B 7/02

[52] U.S. Cl. ..... 81/467

[58] Field of Search ..... 81/467, 468, 471, 472, 81/474, 477, 478, 480, 481

[56] References Cited

U.S. PATENT DOCUMENTS 3,283,620 11/1966 Bailey ..... 81/477
4,314,490 2/1982 Stone ..... 81/479
4,664,001 5/1987 Denman ..... 81/479

FOREIGN PATENT DOCUMENTS 0968194 5/1975 Canada ..... 81/477

*Primary Examiner*—Frederick R. Schmidt
*Assistant Examiner*—Lawrence Cruz
*Attorney, Agent, or Firm*—Lahive & Cockfield

[57] ABSTRACT

A torque wrench comprising an Allen wrench, a read-out member and a holder member for securing the dial to the Allen wrench. Bending of a portion of the wrench, as measured by the read-out member, is indicative of applied torque.

19 Claims, 2 Drawing Sheets

TORQUE WRENCH

RELATED PATENT APPLICATION

This Application is related to co-pending patent application Ser. No. 204,607 entitled "Torque Wrench with Amplifying Gauge", and patent application Ser. No. 204,712 now abandoned entitled "Torque Wrench" both filed on even date herewith, the specification of both being incorporated herein.

BACKGROUND AND OBJECTS OF THE INVENTION

This invention relates to hand tools, and more particularly to torque wrenches.

A torque wrench is a hand tool which allows the user to tighten a threaded fastener to a predetermined torque. Using a torque wrench helps prevent over-tightening which can lead to stripping of threads, break-off of fasteners or other difficulties. It also helps prevent under-tightening which can result in the fastener failing to perform, such as by working itself loose over time.

Generally an inexpensive variety of torque wrench in prevalent use is the "beam" type shown in FIG. 1 and designated 10. At one end, a male socket head 12 is provided for use with interchangeable sockets (not shown). A handle 14 is located at the other end, with a straight beam 16 interposed between the socket head 12 and the handle 14. The beam 16 is a metal rod, for example, having a cylindrical geometry with a length of approximately 15 to 24 inches (38 to 61 cm). A dial 18 is affixed to the beam 16 at a point adjacent to the handle 14. A needle, or pointer 20 is secured at or near the socket head 12, extending towards the handle 14, parallel to the beam 16, and culminating at its free end with a marker or point 22 situated within a slot or elongate window 24 in the dial 18. The slot 24 extends generally in a direction perpendicular to the beam 16.

In use, the beam-type torque wrench 10 is secured to a threaded fastener (not shown), such as a hexagonal headed bolt or screw or a nut by means of interchangeable sockets attached to the socket head 12. An operator turns the wrench 10 via handle 14 in either of the directions indicated by the arrows "a" or "b", and thereby tightens or loosens the fastener. During tightening, the torque wrench 10 fulfills its primary purpose by providing a read-out or display of the torque applied to the fastener. Initially during tightening of the fastener, substantially all manually applied torque results in a turning of the socket head 12. At some point, however, the turning of the wrench 10 by handle 14 results in not only the turning of the socket head 12, but also a bending or bowing of the beam 16. For example, this can occur when the fastener starts to seat. During this condition, the end of the beam 16 adjacent the handle is displaced in the direction of arrow "a" relative to the remainder of the beam 16. Since needle 20 floats at its distal end, being not attached at that end to the beam 16, the needle's marker 22 moves relative to the dial's scale. When the user sees that the needle has swung to a preselected torque read-out, the fastener has been tightened to the proper amount.

Other types of torque wrenches are also known. For example, dial-type and adjustable torque wrenches are intended for more professional mechanics. These torque wrenches are generally more expensive than beam-type wrenches, although the former are typically more accurate and sensitive, and sometimes more delicate than beam-type wrenches.

An object of the invention is to provide a relatively inexpensive torque wrench; one which can be used and discarded by purchasers of products requiring assembly using a torque wrench.

A further object of the invention is to provide a torque wrench of simple yet rugged design which can be readily manufactured and then packaged without the need for specialized packing materials to protect the torque wrench during transit.

SUMMARY OF THE INVENTION

The objects of the invention are accomplished by a torque wrench comprising, and preferably consisting essentially of, an "L" shaped torque transmitting rod wrench, a read-out member or dial, and a holder member for securing the read-out member to the torque transmitting rod. Bending of a portion of the wrench, as measured by the read-out member, is indicative of applied torque.

The torque transmitting rod comprises an "L" shaped, torque transmitting rod such as an Allen wrench, including a first leg connected end-wise and substantially perpendicularly to a second leg. The second leg culminates in a fastener engaging tip.

The read-out member includes a scale marked to quantitatively indicate applied torque.

The holder member can take the form of any of several embodiments. For example, it includes a hollow tube defining a central bore adapted for slip-on attachment onto the second leg in a manner exposing the fastener engaging tip. Preferably, the holder is attached to the second leg near the engaging tip of that leg. The tube includes attachment features or is integrally made with the read-out member. The read-out member attachment features include a groove, flexure tabs and/or a detent. The read-out member is supported so that it is in proximity to the first leg of the wrench.

The fastener engaging tip preferably has a hexagonal cross-section, though the invention can be practiced by providing other fastener engaging drives such as, for example, a flat or philips head.

BRIEF DESCRIPTION OF THE DRAWINGS

The foregoing and other objects of this invention, the various features thereof, as well as the invention itself, may be more fully understood from the following description when read with reference to the accompanying drawings, in which.

DESCRIPTION OF THE PREFERRED EMBODIMENT

A torque wrench 20 made in accordance with the invention includes and preferably consists essentially of a read-out member or dial secured by a holder to a wrench adapted for indicating the amount of applied torque. The following detailed description will enable one skilled in the art to practice the invention.

Figure 1:
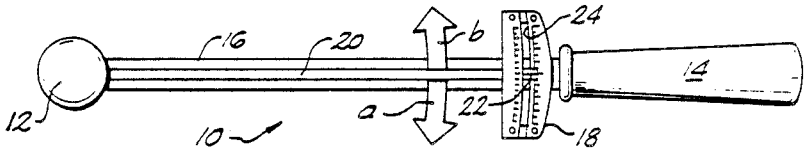
FIG. 1 (PRIOR ART)
FIG. 1 is a top plan view of a prior art torque wrench.
Figure 2:
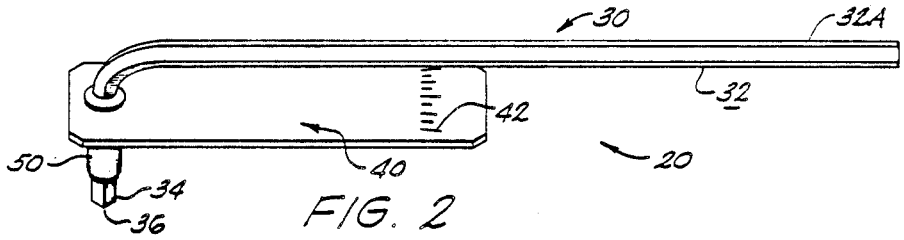
FIG. 2 is a perspective view of a torque wrench in accordance with the invention.
Figure 3:
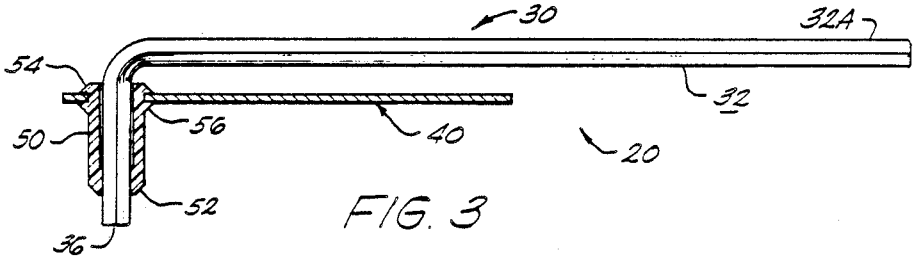
FIG. 3 is a side elevational view, partially in section, of the torque wrench of FIG. 2.
Figure 4:
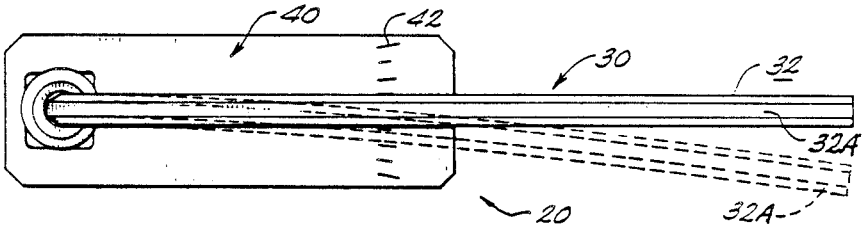
FIG. 4 is a top plan view of the torque wrench of FIG. 2.

As shown in FIGS. 2 through 4, inclusive, the wrench 30 preferably is an Allen wrench formed from a single piece of hexagonal rod or bar stock and bent to a right angle, so as to form an "L" shaped driver. The wrench 30 includes, and preferably consists essentially of, a relatively long first (handle) leg 32 and a relatively short second (drive) leg 34 connected end-wise to the first leg 32. The first leg 32 and second leg 34 are substantially straight except in the region of their connection. The distal end of the second leg 34 defines a fastener engaging tip 36. In the preferred form of the invention, the entire rod is characterized by a hexagonal cross-sectional configuration. However, it is only the tip 36 which needs to be of that cross-section and therefore the balance of the wrench 30 can have a different cross-section, such as circular.

In use, the fastener engaging end 36 is receivable within and is rotationally engageable with an axial hexagonal hole referred to as a hex socket in the head of a threaded fastener, such as, for example, a socket head cap screw (not shown). The first leg 32, of the wrench 30 is, in use, manually rotated about the central axis of the second leg 34, thereby affecting rotation of the screw. As such, the first leg 32 is in the nature of a lever arm and provides mechanical advantage in the turning of the screw.

Those skilled in the art, or even those generally familiar with hand tools, will recognize the driver as previously described since it is in common use. The novelty of the present invention lies in the combination of the driver with the features described below.

The read-out member 40 preferably comprises a tag in the form of a rigid sheet of material, such as a plastic or aluminum, having marked thereon a scale 42. The scale 42 comprises a series of lines, or indicia, marked or imprinted on the surface of the read-out member 40, opposing the first leg 32. It may also include, in addition to or instead of the lines, a plurality of alpha-numeric or other symbols. The read-out member 40 preferably is of an elongated shape such as rectangular, though other configurations can be used.

The holder 50 comprises and preferably consists essentially of a plastic hollow tube fictionally affixed to a region of leg 34, preferably near the distal tip 36. The holder 50 may be formed with a resilient material, permitting use with wrenches having leg 34 with different sized cross-sections. As shown, the holder 50 has an axial length shorter than the leg 34 so that the fastener engaging tip 16 extends beyond the lower edge of the tube. The holder 50 serves as means for maintaining the read-out member 40 at a pre-selected angular orientation with respect to the tip 36, and for mounting the read-out member 40 to that leg 34. The read-out member 40 may be friction fit to the holder 50, permitting angular adjustment of the position of that member 40 about the central axis of leg 34.

The markings of scale 42 are preferably disposed along radii extending from the second leg 34. The holder 50, for example, captures the read-out member 40 between a head portion 54 and radially extending tabs 56, which for ease in assembly can be flexure tabs. Alternatively, a groove or other detent arrangement can be employed to prevent movement of the read-out member 40 in an axial direction along the tubular holder 50. In alternative embodiments, the read-out member 40 and holder 50 may be an integral configuration.

In the preferred embodiment, the read-out member 40 is attached to the holder 50, and the holder 50 is secured to the wrench 30, near the tip 36 of leg 34. The preferred manner of securing the holder 50 to the wrench 30 is by means of an interference fit between the outer circumferential surface of the second leg 34 and a bore formed within the lowermost region 52 of tubular holder 50. The hexagonal shape of the fastener engaging tip 36 provides a plurality of circumferentially disposed projecting corners which aids in preventing rotational movement of the holder 50 with respect to the region of the second leg 34 near the tip 36. Alternatively, the bore can be configured to prevent rotation by having a mating hexagonal or even a square cross-section or otherwise being keyed to a pre-determined angular orientation of the second leg 34.

In use, a circumferential force is applied to the distal tip 34A of the leg 34, while that leg is rotated about the central axis of the leg 32 and the distal tip 36 is maintained in a fixed position. The remainder of leg 32 is angularly displaced in increasing amounts about that central axis of leg 34, and the leg 32 bends in the circumferential direction (as shown in FIG. 4). With this configuration, the angular position of the distal tip 32A of leg 32, as measured with respect to the angular position of the tip 36 of leg 34 is related to the torque applied by a user to a fastener in contact with tip 36, and may be readily determined by viewing the position of the tip 32A with respect to the indicia 42 on read-out member 40.

Figure 5:
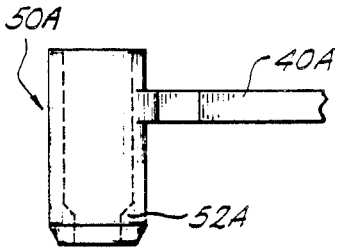
FIGS. 5 and 6 are respectively side elevational and top partial views of an integrally constructed holder and read-out member in accordance with the invention.
Figure 6:
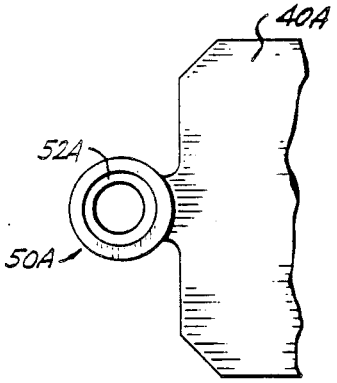

FIG. 5 and 6 depict an alternative embodiment of the holder, designated 50A, with a tube-to-wrench coupling region 52A. In this embodiment the holder 50A in integrally fashioned in one piece with the read-out member, which is designated 40A to distinguish it from that shown in FIGS. 2 through 4. The holder 50A comprises and preferably consists essentially of a tube attached intermediate its axial extent to the midpoint of one edge of holder 40A. As is preferably the case, regardless of the embodiment of the holder employed, the read-out member extends perpendicularly relative to the central axis of the holder.

The operation or use of the torque wrench 20 shall now be explained in conjunction with the embodiment shown in FIGS. 2–4.

The first leg 32 of the wrench 30 is gripped by one hand along the portion thereof distal from the second leg 34. With the other hand, the read-out member 40 is rotated about the central axis of the second leg 34 so as to be angularly oriented such that the first leg 32 is normally above a reference location or datum identified by the scale 42. Alternatively, and preferably, the proper angular orientation is achieved when the tubular holder is slipped over the second leg 34. The fastener engaging end is then inserted into the hex-socket of the screw to be tightened. Torque is then applied to the wrench and is transmitted from the first leg 32 to the second leg 34 and then to the screw head. The wrench and screw are thus turned together.

As the material into which the screw is being turned begins to resist further turning, the applied torque results not only in rotation about the axis extending through the second leg 34 of the wrench 30 but also twisting of the second leg 34 and/or a bending of the first leg 32 relative to the reference location on the scale 42. This bending and/or twisting causes the leg 32 to be displaced relative to the reference datum of the scale 42. The first leg 32 assumes the position designated 32, for example, when a pre-selected torque level has been reached. By appropriate calibration of the scale as is well within the skill of one in this art, the scale indicates the torque applied by measuring the amount of this displacement. The calibration must of course take into account the dimensions and material properties of the wrench 30 if it is to be determined mathematically. Preferably, however, it is arrived at empirically.

The invention can be embodied in other specific forms without departing from the spirit or essential characteristics thereof. For example, while in the above described embodiment the fastener engaging tip 36 has a hexagonal cross section, the invention can be practiced by substituting other configurations suitable to engage fasteners requiring slotted, Philips, hex-head, star, security or other drivers. Such configurations can be integrally made by techniques known to those skilled in the art.

Further, in all of the above described embodiments, the holder 50 includes a tube-to-wrench coupling region 52 which is adapted to affix the holder 50 to the wrench at a portion of the wrench near the drive end 36. As a consequence, the displacement of the tip 32A is a measure of the twisting of leg 34 and the bending of leg 32. In alternative embodiments, the tube-to-wrench coupling region 52 may be adapted to affix the holder 50 to the wrench at a point of the wrench away from tip 36 so that the displacement of tip 32A is a measure of the bending of leg 32 only.

Figure 7:
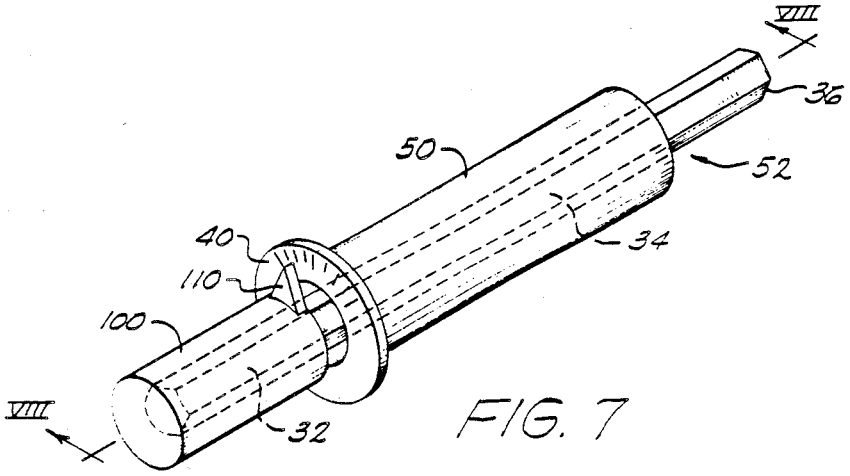
FIG. 7 shows in perspective an alternative form of the invention.
Figure 8:
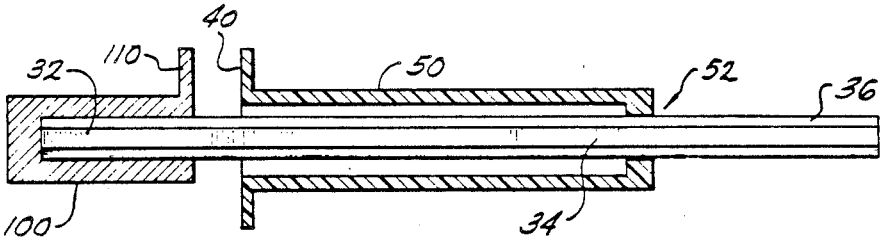
FIG. 8 shows a sectional view of the wrench of FIG. 7 along lines VIII—VIII.

FIGS. 7 and 8 show an alternative form of the present invention which is similar to that shown in FIG. 2, but where the legs 32 and 34 both extend along the same linear axis. In FIG. 7, elements corresponding to elements in FIG. 2 are identified with the same reference designations. In this form of the invention, a handle 100 affixed to leg 32 provides a reference (or "pointer 110") against which the relative angular displacement of the read-out member 40 is measured. That displacement is a measure of torque applied. In other forms, the pointer 110 may be affixed to element 52 and the read-out member 40 may be affixed to leg 32 (or handle 100).

The described embodiments of the invention are to be considered in all respects as illustrative and not restrictive, the scope of the invention being indicated by the depend claims rather than the foregoing description, and all changes which come within the meaning and range of equivalency of the claims are therefore intended to be embraced therein.

I claim:

1. A torque wrench comprising:

torque transmitting rod including a first leg, and a second leg connected end-wise to said first leg, and having a fastener engaging tip at a distal end of said second leg, said distal end being opposite to the end connected to said first leg a read-out member; and holder member including means for establishing slip-on attachment of said holder member to said second leg and means for supporting said read-out member adjacent to at least of portion of said first leg.

2. The torque wrench of claim 1 wherein said means for establishing slip-on attachment is adapted for attachment to said torque transmitting rod near said distal end of said second leg.

3. The torque wrench of claim 1 wherein said torque transmitting rod has a one piece integral construction.

4. The torque wrench of claim 3 wherein said fastener engaging tip has a hexagonal cross-section.

5. The torque wrench of claim 1 wherein said holder member comprises a tube connected to said read-out member and disposed about said second leg and having an axial extent less than that of said second leg, such that said second leg extends beyond said tube.

6. The torque wrench of claim 5 wherein said read-out member further includes a hole through which said tube is received.

7. The torque member of claim 5 wherein said attachment means is adapted for attachment to said rod near said distal tip of said second leg.

8. The torque wrench of claim 6 wherein said holder member includes means supporting said read-out member at points disposed about the principal axis of said second leg said read-out member.

9. The torque wrench of claim 8 wherein said means for supporting said read-out member at points disposed about the principal axis of said second leg includes a plurality of circumferentially spaced outwardly projecting flexure tabs disposed along the axial extent of said tube.

10. The torque wrench of claim 1 wherein said holder member comprises a tube of plastic material disposed about said.. second leg and including read-out member attachment means for securing said read-out member to said tube.

11. The torque wrench of claim 10 wherein said read-out member comprises a substantially rigid sheet secured at one end thereof to said tube.

12. The torque wrench of claim 11 wherein said holder member and said read-out member have an integral, one-piece construction.

13. The torque wrench of claim 1 wherein said means for establishing slip-on attachment a substantially non-rotating attachment of said holder member to said second leg.

14. A torque wrench comprising n allen wrench having a handle leg and a drive leg, a read-out member, and a holder member for securing said read-out member to said Allen wrench at a point on said drive leg, wherein said read-out member includes a plastic tube, and means for securing said read-out surface to said tube with said read-out surface being adjacent to at least a portion of said handle leg.

15. The torque wrench of claim 14 wherein said holder member and said read-out member are integrally constructed.

16. The torque wrench of claim 14 wherein said Allen wrench has a hexagonal cross-section and is molded of plastic.

17. The torque wrench of claim 1 wherein said first leg extends substantially perpendicular to said second leg.

18. A torque read-out gauge assembly for connection to the fastener driving end of a wrench having a first leg and a second leg connected to and extending substantially perpendicular to said first leg, comprising:

a read-out member and holder member including means for establishing slip-on attachment of said holder member to said second leg, and for supporting said read-out member adjacent to at least a portion of said first leg.

19. The torque read-out gauge assembly wrench of claim 18 wherein said means for establishing slip-on attachment is adapted for attachment to said end near a distal end of said second leg, said distal end being opposite to the end connected to said first leg.

* * * * *